United States Patent [19]

Schacht

[11] 3,942,295

[45] Mar. 9, 1976

[54] BASEBOARD ASSEMBLY

[76] Inventor: Peter Schacht, Miesenbacherstrasse 69, 8222 Ruhpolding, Germany

[22] Filed: Mar. 26, 1974

[21] Appl. No.: 454,818

[30] Foreign Application Priority Data

Mar. 27, 1973 Germany ..... 2315281

[52] U.S. Cl. ..... 52/288; 52/631; 52/716

[51] Int. Cl.[2] ..... F04B 1/00

[58] Field of Search ..... 52/287, 288, 716, 242, 52/631

[56] References Cited

UNITED STATES PATENTS

| | | | |
|---|---|---|---|
| 1,315,260 | 9/1919 | Tischler | 52/288 |
| 2,069,289 | 2/1937 | Swendsen et al. | 52/288 |
| 3,440,790 | 4/1969 | Nerem | 52/631 |
| 3,444,657 | 5/1969 | Swanson | 52/288 |

*Primary Examiner*—Frank L. Abbott
*Assistant Examiner*—Carl D. Friedman
*Attorney, Agent, or Firm*—Michael J. Striker

[57] ABSTRACT

The baseboard arrangement includes a fairing unit, which is used in conjunction with a baseboard member of the type comprised of a flat foot portion adapted to lie flat against a floor surface and a vertical wall-facing portion adapted to lie flat against the meeting wall surfaces of a projecting corner of a room or corridor, for example. The flat foot portion of the baseboard member is slitted in direction transverse to the elongation of the baseboard member, with the slit terminating at the vertical wall-facing portion of the baseboard member. Accordingly, the baseboard member, at the region of such slit, can be bent around the projecting corner, thereby causing the slit to spread and form a larger corner gap. The fairing unit includes two flat leg portions adapted to lie flat against the floor surface along the meeting walls of the projecting corner, underneath part of the foot portion of the baseboard member, and these leg portions enclose a substantially right angle. The fairing unit is furthermore comprised of a raised corner portion adapted to fill the corner gap in the bent baseboard member, and at least one vertical wall-facing portion adapted to lie flat against at least one of the meeting wall surfaces of the projecting corner, behind part of the vertical wall-facing portion of the baseboard member, and is connected to at least one of the leg portions along the inner edge of such leg portion.

35 Claims, 12 Drawing Figures

BASEBOARD ASSEMBLY

BACKGROUND OF THE INVENTION

The invention relates to fairings for plastic baseboards.

In order to achieve a smooth transition between the floor and wall surfaces of a room use is nowadays made of baseboards which are almost universally of plastic material. Such plastic baseboards are essentially comprised of a flat foot portion which lies flat on the floor surface and of a vertical wall-facing portion which is joined to the foot portion at the inner edge of the latter and which projects vertically upwards and lies flat against the wall surface. Usually, the baseboard is held in place by means of cementing material connecting the baseboard to the floor and/or to the wall surfaces.

When laying down plastic baseboards of this type, difficulties have always arisen when the baseboard is to be made to travel around a projecting corner, e.g., a portion where two wall surfaces meet at right angles. If a plasticmaterial baseboard member is to be bent around a projecting corner of a room, and if no special steps are taken, the flat foot portion of the baseboard member, which is supposed to lie flat against the floor surface, will instead bulge upwards and bend up into contact with the edge of the projecting corner and even into contact with the wall-facing portion of the baseboard member. This is of course intolerable from an aesthetic viewpoint, and furthermore interferes with cleaning in the vicinity of this portion of the baseboard.

Accordingly, the baseboard foot portion, the portion which is to lie flat against the floor surface, is sometimes cut in the region of the baseboard which is to engage the projecting corner, in order to prevent the development of such a bulge. However, instead of the bulge, one now is presented with an unsightly interruption in the continuity of the foot portion of the baseboard member.

In order to avoid this discontinuity, use is sometimes made of two separate baseboard members, the foot portions of which are cut off at an angle of 135°, so that when the two baseboard members are placed against the wall surfaces, their foot portions form a bevel-type joint. In actual practice, this expedient does not constitute a satisfactory solution, because the meeting free end portions of two such baseboard members tend not to be held tightly enough to the wall and floor surfaces at such corner. Generally, these meeting free end portions of the baseboard members become more or less detached within a time period as short as 4 to 6 weeks.

Current practice is to stretch the foot portion of the baseboard member in the region where it is to engage the meeting wall portions of the projecting corner, and then to lay such properly deformed baseboard member into place. However, to effect the necessary stretching prior to laying down of the baseboard, resort must be had to methods which are relatively expensive and time-consuming to perform. Moreover, the expedient itself is usually not completely successful, and the stretching of the corner portion of the baseboard member will often not be exact enough to prevent the development of a bulge in the wall-facing portion of the baseboard member, just above the foot portion of the baseboard member.

SUMMARY OF THE INVENTION

It is a general object of the invention to provide a fairing unit which permits the laying of plastic baseboards around projecting corners in a neat, quick and relatively inexpensive manner.

This object, and others which will become more understandable from the description of specific embodiments, can be met, according to one advantageous concept of the invention, by providing a fairing unit comprised of a flat portion comprised of two flat leg portions which enclose between themselves an angle of about 90°, or somewhat more. The fairing unit further includes a raised corner portion intermediate the two flat leg portions, the raised corner portion being elevated above the upper surface of the two flat leg portions. The fairing unit is further comprised of vertical wall-facing portions which are joined to the flat floor-engaging leg portions at the inner edge portions of the leg portions. The fairing unit is cemented or otherwise secured in place, firmly hugging the projecting corner defined by two meeting wall surfaces and the adjacent floor surface. An elongated plastic baseboard member is then slit, in direction transverse to its elongation, across the entire foot portion thereof, the slit terminating at the wall-facing portion of the baseboard member. The baseboard member is then laid into place, being bent around the projecting corner, so that the two cut surfaces bounding the slit in the foot portion of the baseboard member spread apart to form a more or less right angle. These two cut surfaces abut tightly against the flanks of the raised corner portion of the fairing unit.

In preparation for the laying down of the baseboard member, the fairing unit is put into place against the adjoining floor surface. The bottom of the fairing unit is cemented to the floor surface, and the vertical wall-facing portions of the fairing unit are cemented to the wall surfaces. The fairing unit can be secured in place by other means, for example by means of nails. However, cementing is preferred. The slitted plastic baseboard member is then put into place in the manner described just above, and is cemented to the wall and to the adjoining surfaces of the fairing unit.

The leg portions and the vertical portions of the fairing unit permit a reliable cement connection with the free ends of the slitted foot portions of the baseboard member. When the baseboard member is laid down using a fairing unit according to the invention, no great force is required to effect the desired bending of the baseboard member around the projecting wall corner. Also, the securing in place of the fairing unit, the slitting of the foot portion of the baseboard member, and the subsequent laying down of the baseboard member in place upon the fairing unit and around the wall corner, all require relatively little time.

Instead of the exemplary fairing units illustrated in the drawing and described below, use could also be made of a simpler fairing unit in the form of a single angle member not provided with vertical wall-facing portions. Such a fairing unit would still exhibit many of the advantages of the fairing units illustrated herein. However, such simpler fairing units might be somewhat difficult to secure by means of cement because of their smaller surfaces. The same difficulty would arise with fairing units consisting essentially of a corner portion filling in the gap constituted by the spread-open slit which develops when the slitted baseboard member is bent around the projecting wall corner. But both above-mentioned embodiments are deemed to be advantageous embodiments according to the invention.

The facing surfaces bounding the slit in the foot portion of the base member, described above, should most advantageously tightly abut against the flanks of the raised corner portion of the fairing unit, so that no visible seam is formed, and so that the overall impression is a neat one.

Advantageously, the elevated corner portion of the fairing unit is located intermediate two lines which extend in direction perpendicular to the elongation of the leg portions of the fairing unit and which intersect where the inner edge portions of the two leg portions of the fairing unit meet with each other. This results in a gap-free connection between the raised corner portion of the fairing unit and the cut surfaces bounding the aforedescribed slit in the foot portion of the baseboard member.

Preferably, the two leg portions of the fairing unit enclose an angle greater than 90°. The advantage of this resides in the consideration that the meeting wall surfaces of the projecting wall corner, particularly for example in the region of radiators and the like, may form an angle greater than 90°. If the fairing unit is composed of readily deformable plastic material, then, if the angle enclosed by its leg portions is greater than the angle formed by the meeting wall surfaces, the leg portions can be bent together until the angle which they enclose equals the angle formed by the meeting wall surfaces. In such event, the fairing unit will bulge only in the region of its elevated corner portion, in downwards direction, and only slightly. This slight downwards bulging is scarcely noticeable, however, and can be ignored.

In dependence upon the angle expected to be formed by the meeting wall surfaces at the wall corner, the angle enclosed by the two leg portions of the fairing unit can be between about 90° and about 110°. Experience has shown that an angle of about 100° is particularly advantageous. In any event, the angle enclosed by the two leg portions of the fairing unit should not be smaller than the angle formed by the meeting wall surfaces in the region of the wall corner, since otherwise the fairing unit would bulge in upwards direction in the region of its elevated corner portion in response to bending of the leg portions thereof in a direction increasing the angle enclosed thereby; such bulging in upwards direction is to be avoided.

The elevated corner portion of the fairing unit will have side surfaces which enclose between themselves an angle having its vertex near the inner corner portion of the fairing unit, i.e., near the portion closest to the wall corner. Advantageously, this angle will be the 180°supplement of the angle enclosed by the leg portions of the fairing unit. If the fairing unit is thusly configurated, it is assured that there will be no gaps at the side surfaces of the elevated corner portion of the fairing unit, and it is assured that the foot portion of the baseboard member will not overlap the elevated corner portion of the fairing unit. The assumption is that the leg portions of the fairing unit will always be bent together to such an extent as to include between themselves the same angle as is included between the meeting wall surfaces of the projecting corner.

In order that the portions of the fairing unit which underlie the foot portion of the baseboard member not be disagreeably conspicuous, it is advantageous to make the width of the flat leg portions of the fairing unit equal to the width of the foot portion of the baseboard member. If, on the other hand, the leg portions of the fairing unit are not be be visible whatsoever, then their width must be smaller than the width of the foot portion of the baseboard member.

Advantageously, the height of the raised corner portion of the fairing unit, measured up from the upper surfaces of the leg portions of the fairing unit, is equal to the thickness of the foot portion of the baseboard member, so that the upper surfaces of both the foot portion of the baseboard member and also of the raised corner portion of the fairing unit will be at the same level.

In order that the top surfaces of the foot portions of the baseboard and the top surface of the raised corner portion of the fairing unit merge smoothly into each other without any projecting edges, the dimensions and the form of the side surfaces of the raised corner portion of the fairing unit are advantageously made to correspond to the form and dimensions of the cut surfaces of the foot portion of the plastic baseboard member, when the cut is made perpendicular to the direction of elongation of the plastic baseboard member. If the baseboard member has such a cross-section that its vertical wall-facing portion merges with a considerable radius in its foot portion, the fairing unit has to be of a corresponding form. That means, that the surface of the raised corner and the surface of the flat leg portions raises from their front ends rearwardly in correspondence with the surface of the baseboard member.

In order to create an aesthetically pleasing overall impression, the outer corner of the fairing unit in the region of its raised corner portion is rounded off.

The length of the leg portions of the fairing unit advantageously amounts to between about 2 and about 10 cm, and preferably about 6 cm, in order to assure a good securing and especially a good cementing to the fairing unit to the floor surface.

In order that the ends of the leg portions of the fairing unit not show through the overlying parts of the baseboard member, and most certainly not form a conspicuous discontinuity in the visible surfaces of the baseboard member, it is advantageous to so configurate the fairing unit that its leg portions decrease in thickness in direction parallel to the wall surfaces and away from the raised corner portion of the fairing unit and/or in direction away from the wall surfaces.

Advantageously, the leg portions and the raised corner portions of the fairing unit are of one piece with each other. However, where it appears to be advantageous, the raised corner portion can be manufactured as a separate member and then mounted on top of the intersection of the two leg portions of the fairing unit by means of cement, rivets, welding, or the like.

Advantageously, the vertical wall-facing portions of the fairing unit have a height equal to the height of the vertical wall-facing portion of the baseboard member. In this way, the vertical wall-facing portions of the fairing unit will not project upwardly beyond the overlying vertical wall-facing portion of the baseboard member. Alternatively, the vertical wall-facing portions of the fairing unit can have a height less than the height of the vertical wall-facing portion of the baseboard member. In this way, the vertical wall-facing portions of the fairing unit will not be visible at all.

In order that the vertical wall-facing portion of the baseboard member lie as smoothly and flat as possible against the wall surface, and in order that the presence of the underlying vertical wall-facing portions of the fairing unit be as little noticeable as possible, the fairing unit is advantageously so designed that the thickness of the vertical wall-facing portions of the fairing unit decreases in thickness in upwards direction and/or decreases in thickness in direction away from the corner portion of the fairing unit.

The room and corridor corners formed by meeting wall surfaces are often non-uniform, uneven, or in order manner not of ideal form. In order to permit an adjustment of the fairing unit to the particular situation encountered, it is advantageous that the vertical wall-facing portions of the fairing unit not be connected with each other at the portion corresponding to the intersection of the meeting wall surfaces, and that such vertical wall-facing portions instead be slitted at this region, or otherwise separated so as to form a gap which widens in upwards direction, i.e., in direction perpendicularly away from the floor surface. This makes for very easy fitting of the fairing unit into place against a corner having a somewhat irregular or imperfect shape.

The fairing unit is advantageously composed of plastic material. In order that the fairing unit be easily fitting into place against the wall and floor surfaces of the corner of a room or corridor, it is advantageous that such plastic material be relatively easily deformable. Depending upon the method of manufacture of the fairing unit, it will be advantageous to use a duroplastic or thermoplastic material. The fairing unit can advantageously be cast or injection molded. Advantageously the fairing unit, including its leg portions, raised corner portions and vertical wallfacing portions, is composed of one single piece of material. In order that the fairing unit blend into the baseboard member in as convincing a manner as possible, the fairing unit is preferably of the same color, material and surface finish as the baseboard member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
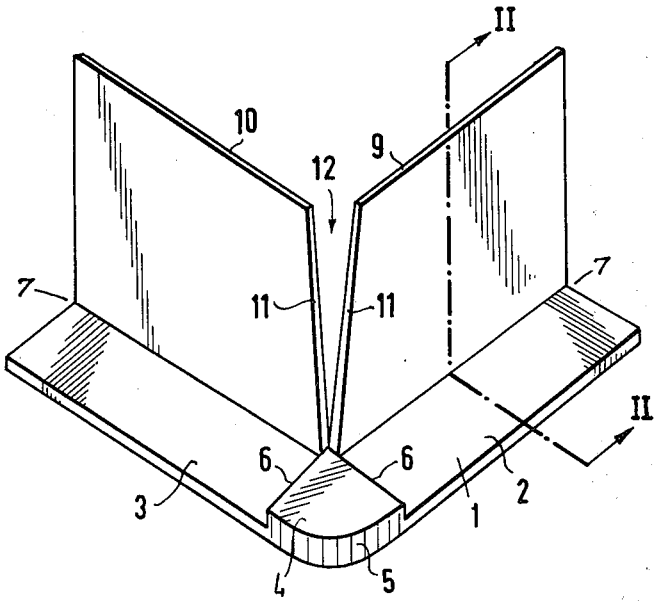
FIG. 1 is a perspective view of one fairing unit according to the invention.

The fairing unit shown in FIG. 1 is comprised of a flat base portion 1 having two leg portions 2 and 3. The leg portions 2 and 3 enclose between themselves an angle $\alpha = 100°$ (see FIG. 3). A raised corner portion 4 (see FIG. 3) is provided in the middle part of the upper face of the base portion 1 between the two leg portions 2 and 3. The raised corner portion 4 is rounded off in the region of the outer corner portion 5 of the fairing unit, as can be seen in FIG. 1.

Figure 3:
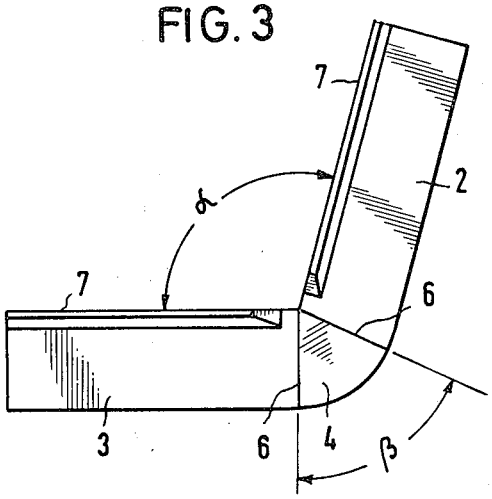
FIG. 3 is a top view of the fairing unit shown in FIG. 1.

The side faces 6 of the raised portion 4 on the base portion 1 enclose between themselves an angle $\beta = 80°$ (see FIG. 3).

Projecting vertically upwards from the base portion 1 at the inner edge portions 7 of the leg portions 2 and 3 are vertical wall-facing portions 9, 10. The adjoining edge portions 11 of these vertical wall-facing portions 9, 10 define a gap 12, which widens in upwards direction.

Figure 2:
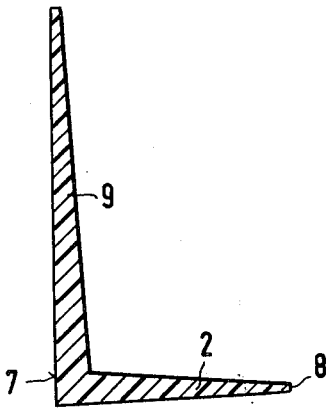
FIG. 2 is a sectional view, taken along section line 11—11 of FIG. 1.

As can be seen clearly in the sectional view of FIG. 2, the leg portion 2 and the vertical wall-facing portion 9 decrease in thickness in direction away from the inner edge portion 7.

The fairing unit shown in FIGS. 1–3 has the following dimensions: The breadth of the leg portions 2, 3 is 12 mm. The length of the leg portions 2, 3 is 50 mm each. The height of the raised portion 4, measured upwards from the upper surface level of the leg portions 2, 3, is 1.2 mm. The height of the vertical portions 9, 10 is 40 mm. The thickness of the leg portions 2, 3 decreases from 0.8 mm at the inner edge portions 7 thereof to 0.4 mm at the outer edge portions 8 thereof. The gap 12 has a breadth of 4 mm at its bottom and 8 mm at its top.

The fairing unit of FIGS. 1–3 consists of a single unitary structure, for example, molded from polyvinylchloride plastic. The plastic material employed is advantageously such that the fairing member can be deformed easily, i.e., so that, for example, the leg portions 2 and 3 can be bent together somewhat to effect a decrease of the angle $\alpha$ (see FIG. 3).

Figure 4:
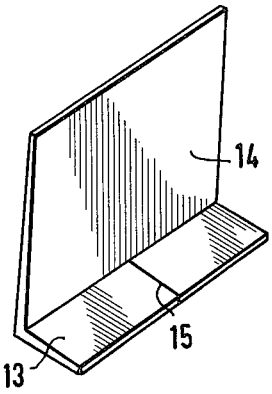
FIG. 4 is a perspective view of a partially slitted baseboard member used in conjunction with the illustrated fairing unit.

FIG. 4 depicts a plastic baseboard member comprised of a foot portion 13 and a vertical wall-facing portion 14. The foot portion 13 is cut in advance at 15 so that it can be used with the fairing unit depicted in FIGS. 1–3.

Figure 5:
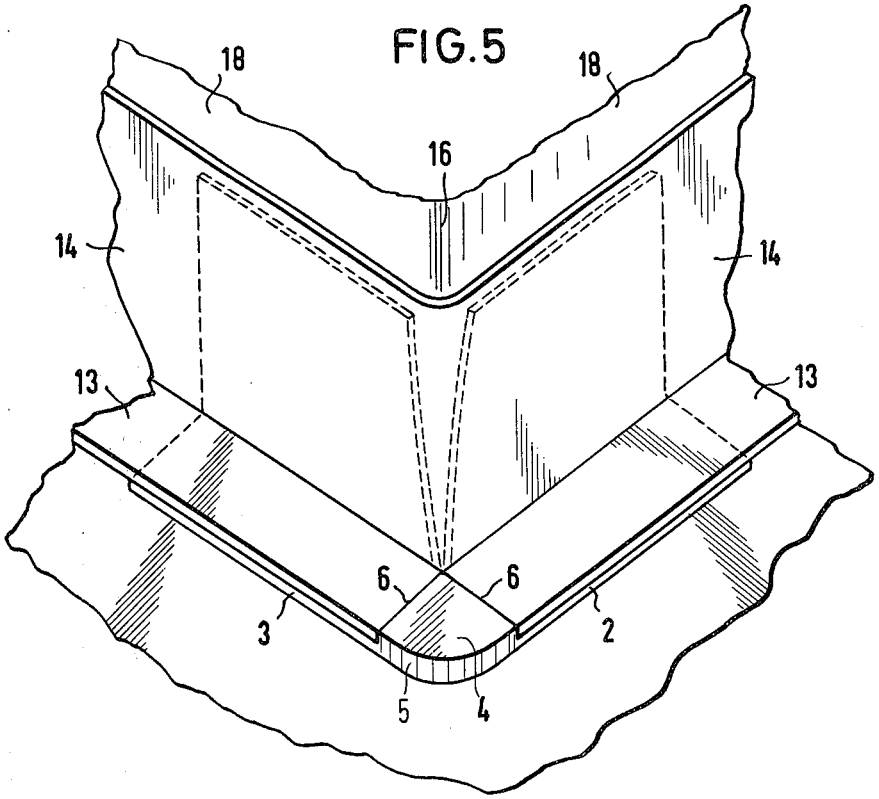
FIG. 5 is a perspective view of the fairing unit of FIG. 1 and the baseboard member of FIG. 4 fitted into place against the wall surfaces of the projecting corner of a room or corridor.

The actual laying down of a plastic baseboard member around a projecting corner will be described with reference to FIG. 5.

To lay down the baseboard, first of all the fairing unit is cemented in place engaging the projecting corner 16 and the floor surface of the room. In the event that the meeting wall surfaces 18 of the corner meet at an angle smaller than the angle $\alpha$ of the fairing unit, then the leg portions 2, 3 of the fairing unit must be bent towards each other until the inner edge portions 7 of the fairing unit lie flat against the wall surfaces 18.

In the event that the leg portions 2, 3 are bent together somewhat in the manner just mentioned, then care must be taken to see that the portion of the fairing unit 1 provided with the raised portion 4 bulges downwardly and not upwardly.

When the fairing unit depicted in FIGS. 1–3 is employed, the vertical wall-facing portions 9, 10 thereof will be cemented to the wall surfaces 18. In this way there is achieved an especially good securing of the fairing unit. Thereafter, the slitted plastic baseboard member 13, 14 of FIG. 4 is bent around the projecting corner 16, so that the cut side surfaces bounding the now widened slit 15 of the baseboard foot portion 13 abut tightly against the side walls 6 of the raised portion 4. Thereupon, the baseboard member is cemented onto the fairing unit and as usual onto the wall.

Figure 6:
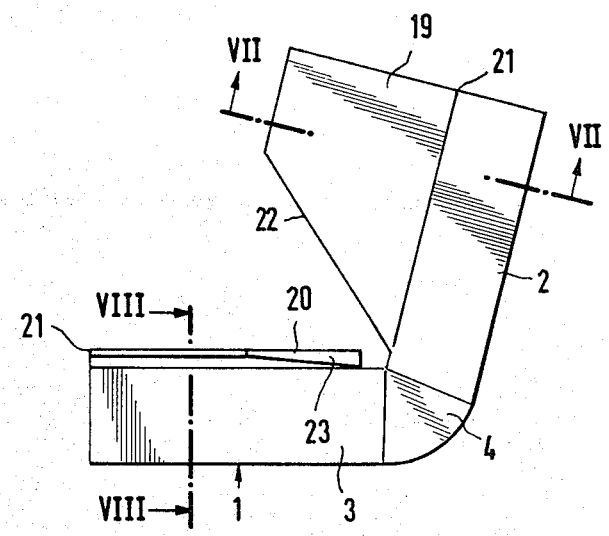
FIG. 6 is a top view of a second fairing unit according to the invention.
Figure 8:
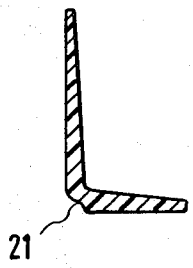
FIG. 8 is a section taken along line VIII—VIII of FIG. 6.
Figure 7:
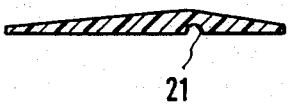
FIG. 7 is a section taken along line VII—VII of FIG. 6.

FIG. 6 depicts a second embodiment of a fairing unit, similar to that of FIGS. 1–3. Like that of FIGS. 1–3, the fairing unit of FIG. 6 is comprised of two leg portions 2, 3, of an elevated portion 4, and of vertical portions 19, 20 connected to the leg portions 2, 3 at the inner edge portions of the latter. When the fairing unit is cast, the two portions 19, 20 lie in the same plane as the leg portions 2, 3, as shown in FIG. 6 with respect to the one portion 19, and as also indicated in the section view of FIG. 7. When used, the portions 19, 20 will of course be bent upwards into vertical orientation, and to facilitate this there is provided on the underside of the fairing unit, between the portions 19, 20 and the leg portions 2, 3, an elongated groove or slit 21, so that this portion of the structure is of reduced cross section. Alternatively, the groove or slit 21 could be provided on the upper surface of the fairing unit 1. Also, in place of the groove or slit 21, an elongated weakened zone can be created by other means, for example by means of perforations and the like. The edge portions 22, 23 of the wall-facing portions 19, 20 are advantageously so inclined, as shown in FIG. 6, that the portions 19, 20 do not overlap each other when they both lie in the plane of the leg portions 2 and 3.

Figure 9:
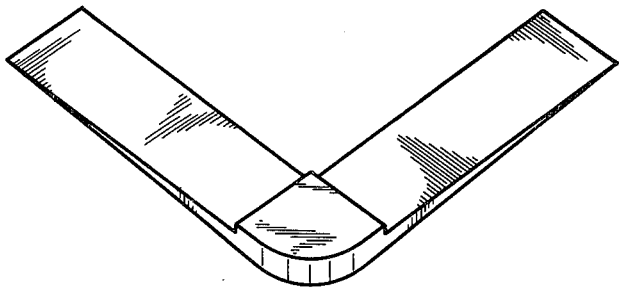
FIG. 9 is a perspective view of another embodiment of a fairing unit according to the invention.
Figure 11:
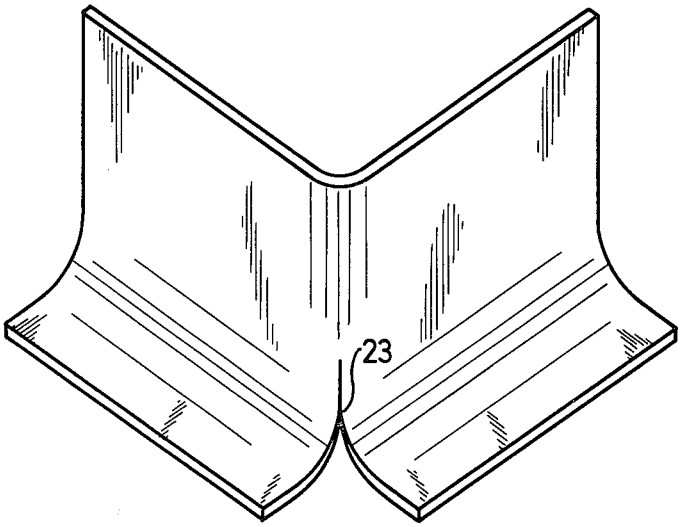
FIG. 11 is a perspective view of a baseboard member the vertical wall-facing portion of which curves and merges into the foot portion.
Figure 12:
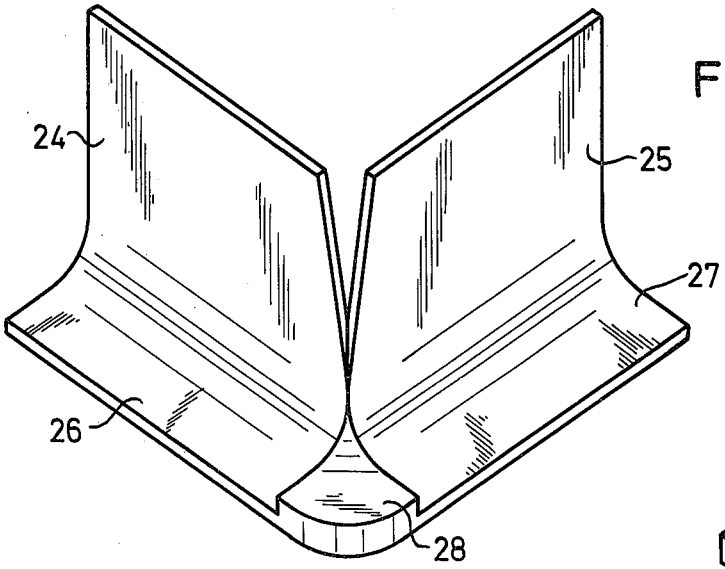
FIG. 12 is a perspective view of another embodiment of a fairing unit according to the invention adapted for use with the type of baseboard member shown in FIG. 11.
Figure 10:
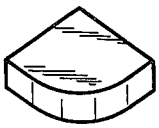
FIG. 10 is a perspective view of another embodiment of a fairing unit according to the invention.

The embodiment of FIG. 6 has several advantages. For one, the casting of the fairing unit can be performed using a simpler mold than would be necessary to cast the fairing unit of FIGS. 1–3, since the fairing unit of FIG. 6, when cast, would be more or less all in one plane. For another, fairing units such as shown in FIG. 6 can be stored flat, and therefore take up less storage room than a fairing unit such as shown in FIG. 1–3. The embodiment of FIG. 9 is the same as shown in FIG. 1 and described above but does not include the vertical wall-facing portions 9, 10 of FIG. 1. The embodiment of FIG. 10 is the same as shown in FIG. 9 and described before but does not include the two leg portions 2 and 3 shown in FIG. 1 nor the vertical wall-facing portions 9 and 10 shown in FIG. 1. The baseboard member shown in FIG. 11 has a vertical wall-facing portion which curves down and merges into its foot portion. This baseboard member is prepared for laying down by forming a cut 23. The embodiment shown in FIG. 12 is fairing unit adapted to be used with the baseboard member of FIG. 11. As in the case of the baseboard member of FIG. 11 the vertical wall-facing portions 24, 25 of the fairing unit merge with a curve of considerable radius into its leg portions 26, 27. Also the surface of the raised corner portion of the fairing unit is curved to properly engage the curved surface of the baseboard member of FIG. 11. With respect to its other details the fairing unit of FIG. 12 is similar to the fairing unit of FIG. 1.

It will be understood that each of the elements described above, or two or more together, may also find a useful application in other constructions, configurations and assemblies differing from the type described above.

While the invention has been illustrated and described as embodied in a fairing unit adapted to lie against the meeting wall and floor surfaces of a projecting corner of a room or corridor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a baseboard arrangement, a synthetic plastic fairing unit for use in conjunction with a synthetic plastic baseboard member of the type comprised of a flat foot portion adapted to lie flat against a floor surface and a vertical wall-facing portion adapted to lie flat against the meeting wall surfaces of a projecting corner and slitted all the way through along the flat foot portion in direction transverse to the elongation of the baseboard member so that the baseboard member at the region of such slit can be bent around such projecting corner thereby causing the slit to spread and form a larger corner gap, the fairing unit comprising two flat leg portions adapted to lie flat against a floor surface along the meeting walls of a projecting corner underneath part of the foot portion of the baseboard member and enclosing between themselves a substantially right angle, a raised corner portion adapted to fill the corner gap in the bent baseboard member, and at least one vertical wall-facing portion adapted to lie flat against at least one of the meeting wall surfaces of a projecting corner behind part of the vertical wall-facing portion of the baseboard member and being connected to at least one of said leg portions along the inner edge portion of such leg portion. adapted to lie flat against a floor surface and a vertical wall-facing portion adapted to lie flat against the meeting wall surfaces of a projecting corner, the flat foot portion being slitted all the way through in direction transverse to the elongation of the baseboard member, the slit terminating at the vertical wall-facing portion of the baseboard member, and the baseboard member being bent at the region of said slit with said slit spread out to form a larger corner gap filled in by said raised corner portion of said fairing unit.

2. In a baseboard arrangement as defined in claim 1, wherein said leg portions have respective inner edge portions adapted to lie close to the meeting wall surfaces of a projecting corner, and wherein said inner edge portions meet at the portion of the fairing unit adapted to lie against the line of intersection of the meeting wall surfaces, and wherein said raised corner portion is located in between two imaginary lines which are each perpendicular to the direction of elongation of a respective one of said leg portions, which are both parallel to the general plane of the leg portions, and which intersect each other where said inner edge portions of said leg portions meet.

3. In a baseboard arrangement as defined in claim 1, wherein said angle is between about 90° and about 110°.

4. In a baseboard arrangement as defined in claim 1, wherein said angle is about 100°.

5. In a baseboard arrangement as defined in claim 1, wherein said raised corner portion has side walls which enclose between themselves an angle approximately equal to the 180°-supplement of the angle enclosed between said leg portions.

6. In a baseboard arrangement as defined in claim 1, and further including a synthetic plastic baseboard member comprised of a flat foot portion adapted to lie flat against a floor surface and a vertical wall-facing portion adapted to lie flat against the meeting wall surfaces of a projecting corner, the flat foot portion being slitted all the way through in direction transverse to the elongation of the baseboard member, the slit terminating at the vertical wall-facing portion of the baseboard member, and the baseboard member being bent at the region of said slit with said slit spread out to form a larger corner gap filled in by said raised corner portion of said fairing unit.

7. In a baseboard arrangement as defined in claim 6, wherein said vertical wall-facing portion of said fairing unit has a height at most equal to the height of said vertical wall-facing portion of said baseboard member, so that the vertical wall-facing portion of said fairing unit does not project upwardly beyond the vertical wall-facing portion of said baseboard member.

8. In a baseboard arrangement as defined in claim 6, wherein the width of said leg portions of said fairing unit is at most equal to the width of said foot portion of said baseboard member.

9. In a baseboard arrangement as defined in claim 6, wherein the height of said raised corner portion of said fairing unit, as measured from the upper surface of said leg portions, is equal to the thickness of said foot portions of said baseboard member.

10. In a baseboard arrangement as defined in claim 6, wherein said raised corner portion of said fairing unit has side walls having a form and dimensions corresponding to those of the facing side surfaces of the slit in said foot portion of said baseboard member.

11. In a baseboard arrangement as defined in claim 1, wherein the fairing unit in the outer region of said raised corner portion thereof is rounded off.

12. In a baseboard arrangement as defined in claim 1, wherein each of said leg portions has a length of between about 2 and about 10 cm.

13. In a baseboard arrangement as defined in claim 1, wherein each of said leg portions has a length of about 6 cm.

14. In a baseboard arrangement as defined in claim 1, wherein the thickness of said leg portions decreases in direction from the inner edge portions thereof to the outer edge portions thereof.

15. In a baseboard arrangement as defined in claim 1, wherein the thickness of said leg portions decreases to either side of said raised corner portion of said fairing unit.

16. In a baseboard arrangement as defined in claim 1, wherein the thickness of said leg portions decreases in direction from the inner edge portions thereof to the outer edge portions thereof and also to either side of said raised corner portion of said fairing unit.

17. In a baseboard arrangement as defined in claim 1, wherein said vertical wall-facing portion of said fairing unit has a thickness which decreases in upwards direction.

18. In a baseboard arrangement as defined in claim 1, wherein said vertical wall-facing portion of said fairing unit has a thickness which decreases in the horizontal direction.

19. In a baseboard arrangement as defined in claim 1, wherein said vertical wall-facing portion of said fairing unit has a thickness which decreases both in upwards direction and in the horizontal direction.

20. In a baseboard arrangement as defined in claim 1, wherein said fairing unit is comprised of two vertical wall-facing portions each adapted to lie flat against one of the meeting wall surfaces of a projecting corner behind part of the vertical wall-facing portion of the baseboard member and each connected to a respective one of said leg portions along the inner edge portion of such leg portion, and wherein said vertical wall-facing portions of said fairing unit have facing edge portions in the region of said corner portion, extending upwards from the respective leg portions and spaced from each other to define a gap.

21. In a baseboard arrangement as defined in claim 20, wherein said vertical wall-facing portion of said fairing unit are so shaped that said gap widens in direction upwards from said leg portions.

22. In a baseboard arrangement as defined in claim 21, wherein the material of said facing unit is so flexible that each of said wall-facing portions of said fairing unit can be bent downwards to lie in substantially the same plane as the respective leg portion of the fairing unit, and wherein said wall-facing portions of said fairing unit are so configurated that when they both lie in substantially the same plane as the respective leg portions of said fairing unit the wall-facing portions of said fairing unit do not overlap each other, whereby to permit flattening of the fairing unit for purposes of compact storage.

23. In a baseboard arrangement as defined in claim 22, wherein the material of said fairing unit is weakened in the regions where the wall-facing portions thereof are connected to the respective leg portions thereof to facilitate bending of the wall-facing portions of the fairing unit into substantially the planes of the respective leg portions.

24. In a baseboard arrangement as defined in claim 23, wherein said fairing unit is provided with elongated weakening grooves each extending along the length of the region where a respective one of the wall-facing portions of the fairing unit is connected to the rspective leg portion, to facilitate such bending.

25. In a baseboard arrangement as defined in claim 1, wherein said fairing unit is composed of a single piece of material.

26. In a baseboard arrangement as defined in claim 1, wherein said fairing unit is comprised of duroplastic material.

27. In a baseboard arrangement as defined in claim 1, wherein said fairing unit is comprised of thermoplastic material.

28. In a baseboard arrangement as defined in claim 1, wherein said fairing unit is a cast part.

29. In a baseboard arrangement as defined in claim 1, wherein said fairing unit is an injection-molded part.

30. In a baseboard arrangement, in combination, a synthetic plastic baseboard member comprised of a flat foot portion adapted to lie against a floor surface and a vertical wall-facing portion adapted to lie flat against the meeting wall surfaces of a projecting corner and slitted all the way through along the flat foot portion in direction transverse to the elongation of the baseboard member with the baseboard member at the region of such slit being bent for placement around such projecting corner so that the slit is spread and forms a corner gap; and a fairing unit comprised of a synthetic plastic corner portion fitting into and filling said corner gap, wherein said fairing unit is further comprised of at least one flat leg portion adapted to lie flat against a floor surface along one of the meeting walls of a projecting corner underneath part of the foot portion of the baseboard member, said flat leg portion being connected to said corner portion.

31. In a baseboard arrangement as defined in claim 30, wherein said corner portion has side surfaces, and wherein the foot portion of the baseboard member has side surfaces formed by the slitting of said foot portion, and wherein the side surfaces of the corner portion and the side surfaces of the slitted foot portion of the baseboard member have such cross-sectional configurations that the upper surface of the corner portion merges continuously into the upper surfaces of the adjoining parts of the foot portion.

32. In a baseboard arrangement, as defined in claim 30, wherein said fairing unit is further comprised of at least one vertical wall-facing portion adapted to lie flat against at least one of the meeting wall surfaces of a projecting corner behind part of the vertical wall-facing portion of the baseboard member and being connected to said leg portion along the inner edge portion of such leg portion.

33. In a baseboard arrangement as defined in claim 30, wherein said baseboard member is so configurated that said vertical wall-facing portion of said baseboard member is connected to said flat foot portion by an intermediate portion having a curved cross-sectional configuration, and wherein said corner portion is so configurated that the sides of said corner portion merge continuously into the upper surfaces of the adjoining parts of said foot portion and furthermore merge continuously into the upper surfaces of the adjoining parts of said intermediate portions.

34. In a baseboard arrangement, in combination, a synthetic plastic baseboard member comprised of a flat foot portion adapted to lie flat against a floor surface and a vertical wall-facing portion adapted to lie flat against the meeting wall surfaces of a projecting corner and slitted all the way through along the flat foot portion in direction transverse to the elongation of the baseboard member with the baseboard member at the region of such slit being bent for placement around such projecting corner so that the slit is spread and forms a corner gap; and a fairing unit comprised of a synthetic plastic corner portion fitting into and filling said corner gap, wherein said baseboard member is so configurated that said vertical wall-facing portion of said baseboard member is connected to said flat foot portion by an intermediate portion having a curved cross-sectional configuration, and wherein said corner portion is so configurated that the sides of said corner portion merge continuously into the upper surfaces of the adjoining parts of said foot portion and furthermore merge continuously into the upper surfaces of the adjoining parts of said intermediate portion, wherein said fairing unit is further comprised of at least one flat leg portion adapted to lie flat against a floor surface along the meeting walls of a projecting corner underneath part of the foot portion of the baseboard member, said flat leg portion being connected to said corner portion.

35. In a baseboard arrangement as defined in claim 34, wherein said fairing unit is further comprised of at least one vertical wall-facing portion adapted to lie flat against at least one of the meeting wall surfaces of a projecting corner behind part of the vertical wall-facing portion of the baseboard member and an intermediate portion connecting said vertical wall-facing portion of said fairing unit to said flat leg portion thereof and having a curved cross-sectional configuration similar to the configuration of said intermediate portion of said baseboard member so that the intermediate portion of said baseboard member lies in contact with the intermediate portion of said fairing unit.

* * * * *